US005465994A

United States Patent [19]

Commier et al.

[11] Patent Number: 5,465,994

[45] Date of Patent: Nov. 14, 1995

[54] DEVICE FOR DAMPING SKI VIBRATIONS

[75] Inventors: Philippe Commier, Annecy; Jacques Le Masson, Cran Gevrier, both of France

[73] Assignee: Salomon S.A., Chavanod, France

[21] Appl. No.: 191,466

[22] Filed: Feb. 4, 1994

[30] Foreign Application Priority Data

Feb. 5, 1993 [FR] France ..... 93 01427

[51] Int. Cl.[6] ..... A63C 5/075

[52] U.S. Cl. ..... 280/602; 280/607

[58] Field of Search ..... 280/602, 607, 280/609, 610, 11.14, 617, 633, 636

[56] References Cited

U.S. PATENT DOCUMENTS

| | | | |
|---|---|---|---|
| 3,260,531 | 7/1966 | Heuvel | 280/602 |
| 4,740,009 | 4/1988 | Hoelzl | 280/602 |
| 4,865,345 | 9/1989 | Piegay | 280/602 |
| 5,269,555 | 12/1993 | Ruffinengo | 280/602 |
| 5,284,357 | 2/1994 | Tinkler | 280/602 |
| 5,332,252 | 7/1994 | LeMasson et al. | 280/602 |

FOREIGN PATENT DOCUMENTS

| | | | |
|---|---|---|---|
| 490044 | 6/1992 | European Pat. Off. | 280/602 |
| 0490043 | 7/1992 | European Pat. Off. | 280/602 |
| 510308 | 10/1992 | European Pat. Off. | 280/602 |
| 521272 | 1/1993 | European Pat. Off. | 280/602 |
| 2503569 | 10/1982 | France . | |
| 2575393 | 7/1986 | France . | |
| 2665081 | 1/1992 | France | 280/602 |
| 3147140 | 6/1983 | Germany | 280/602 |

*Primary Examiner*—Margaret A. Focarino
*Assistant Examiner*—Peter C. English
*Attorney, Agent, or Firm*—Pollock, Vande Sande & Priddy

[57] ABSTRACT

Device for damping the vibrations of a ski, comprising a flexion plate movably connected to the ski by at least two longitudinally spaced damping mechanisms. At least one of the damping mechanisms is a flexible linkage element formed by an interface of pliable material, such as a layer of viscoelastic material welded or glued to the flexion plate. One of the damping mechanisms may be of the dry friction type, or of the viscous friction type.

13 Claims, 10 Drawing Sheets

DEVICE FOR DAMPING SKI VIBRATIONS

FIELD OF THE INVENTION

The present invention relates to a damping device for a ski, e.g., an alpine ski, a cross-country ski, a monoski, or a snow-surfing ski. More specifically, it relates to an improvement made to this type of ski, and also concerns a ski equipped with this device.

BACKGROUND OF THE INVENTION

Different types of skis manufactured incorporating a fairly flexible structure are now conventionally known. A great many variants thereof exist, these consisting of an elongated beam whose front end is curved upward so as to form the tip, and the rear end is also curved upward, but in less pronounced fashion, to form the heel.

Present-day skis normally have a composite structure in which various materials are combined, so that each functions optimally with respect to the distribution of the mechanical stresses generated during skiing. Accordingly, the structure normally comprises peripheral protective elements, interior strengthening elements making it possible to withstand flective and torsional stresses, and a core. Assembly of these elements is effected by adhesive bonding or injection, generally under heat in a mold embodying the final shape of the ski, with a front part significantly raised to form the tip, a rear part slightly raised to form the heel, and a cambered central part.

Despite the manufacturer's preoccupation with producing good-quality skis, they have not, to date, discovered a high-performance ski which proves satisfactory under all conditions of use.

Present-day skis exhibit a number of problems, in particular that of poor performance when undergoing oscillations resulting from ski vibrations or flexion. Indeed, persistent vibrations cause loss of adhesion and thus, poor steering of the ski. It is thus very important to damp the vibrations under good conditions, and, in consequence, solutions have already been suggested. Note should be taken, for example, of the solutions proposed in French Patent Applications Nos. 2 503 569 and 2 575 393. However, the damping devices disclosed in these applications produce only minor effects imperceptible to the skier.

SUMMARY OF THE INVENTION

The present invention is intended to solve the various problems previously mentioned and proposes an especially simple, effective, and reliable solution to vibration-damping problems, by combining the advantages of localized vibration dispersion by means of minimal deformations, and, in a shifted configuration, by taking advantage of much greater motion. Moreover, the device according to the invention does not impart excessive additional localized stiffness to the ski.

Thus, the damping device designed to damp the vibrations of a ski according to the invention comprises a flexion plate designed to be connected to the ski, and at least two damping mechanisms by means of which this plate is designed to be attached to the ski in movable fashion, these damping mechanisms being connected to the flexion plate at points which are spaced apart longitudinally by a certain distance.

According to a supplementary feature, the flexion plate is a plate, a section, or a metal retaining ring made of aluminum, steel, or a composite material. It has a section of between 5 and 300 $mm^2$. It is between 100 and 1,200 millimeters in length. The flexion plate is flexible under flexion and produces no additional static stiffness under flexion (i.e., its stiffness is negligible in relation to the rest of the ski).

According to another feature, at least one of the damping mechanisms is a flexible linkage element formed by an interface made of a pliable material.

According to one embodiment, the two damping mechanisms are flexible linkage elements constituted by an interface made of a pliable material, and, in particular, by a layer of a viscoelastic material welded or glued to the flexion plate.

In another embodiment, one of the damping mechanisms is of the dry friction type, while, in a variant, it is of the viscous friction type.

The invention also relates to a ski equipped with a damping device.

BRIEF DESCRIPTION OF THE DRAWINGS

Other features and advantages of the invention will become manifest in the following description, which makes reference to the attached drawings provided solely by way of example and in which:

FIG. 1 is a lateral view, FIGS. 1*a* and 1*b* illustrating construction details.

FIG. 2 is a top plan view.

FIG. 3 is a side view of the ski in the flexed position, FIGS. 3*a* and 3*b* illustrating operating details.

FIGS. 4 and 5 represent another embodiment, FIG. 4 being a partial top plan view, while FIG. 5 is a partial rear view in perspective.

FIGS. 15, 15*a*, and 15*b* show the ski under flexion.

FIGS. 19 and 20 are cross-section views along lines XIX—XIX and XX—XX of FIG. 18, respectively.

DETAILED DESCRIPTION

Figure 1:
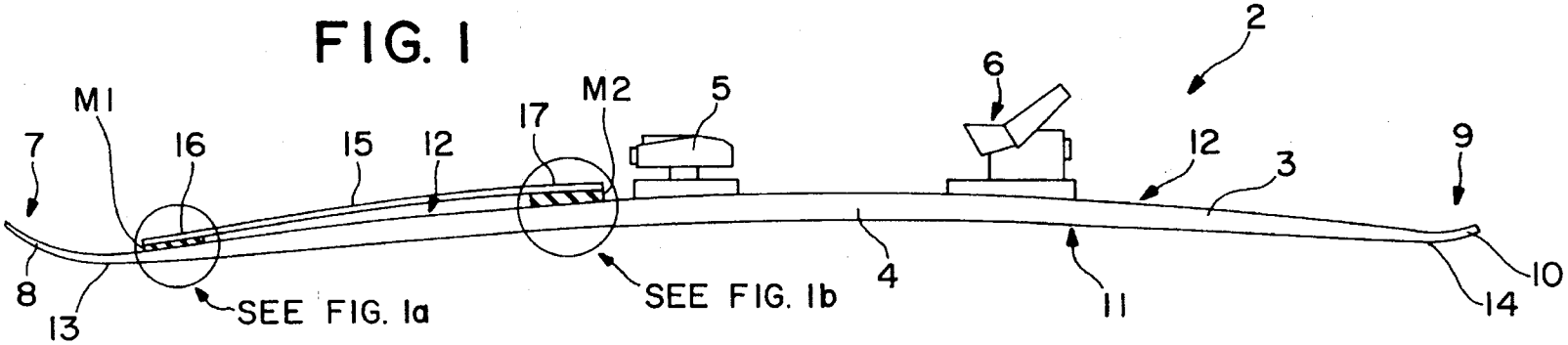
FIGS. 1 to 3 represent a first embodiment of the invention.

The damping device according to the invention is designed to be attached to a ski 2. Because this ski is conventionally known, it will not be described in detail. It consists of an elongated beam 3 having a characteristic thickness and width distribution, and thus its own characteristic stiffness. It comprises a central part 4, also termed the binding 5,6-mounting area, the bindings being designed to hold the boot in place on the ski, the front binding 5 being usually called a stop-motion device, while the rear binding 6 is generally called the heel piece. The front end 7 of the ski 2 is raised so as to form the tip 8, while the rear end 9 is also raised so as to form the heel 10 of the ski. The beam further consists of a lower, sliding surface 11 and an upper surface 12. It should be noted that contact between the lower surface 11 and the snow occurs between the front point of contact 13 and the rear point of contact 14, which correspond to the places where the aforementioned lower surface begins to curve upward.

The damping mechanism is constituted by a flexion plate 15, which consists, for example, of an aluminum strip having a thickness "e" of between 1 and 5 millimeters, a width "1" of between 10 and 60 millimeters, and a length "L" of between 100 and 1,200 millimeters. According to the invention, the flexion plate 15 is fastened to the ski in longitudinally movable fashion by damping mechanisms, so as to be able to move in its entirety over its entire length in relation to the ski. To this end, the first linkage area 16 for connection of flexion plate 15 is fastened to the ski by first linking means (M1), while the second linkage area 17 connecting the flexion plate 15 is attached to the ski by second linking means M2. According to one inventive feature, the second linkage area 17 is spaced longitudinally apart from the first linkage area 16 by an average distance D, and the first and second linking means M1, M2 are also damping mechanisms.

In the embodiment illustrated in FIGS. 1 to 5 and in FIGS. 11 to 20, the damping device as shown is positioned at the front of the ski. Accordingly, the flexion plate 15 extends longitudinally over a length "L" between the front stop-motion device 5 and the forward point of contact 13.

Figure 2:
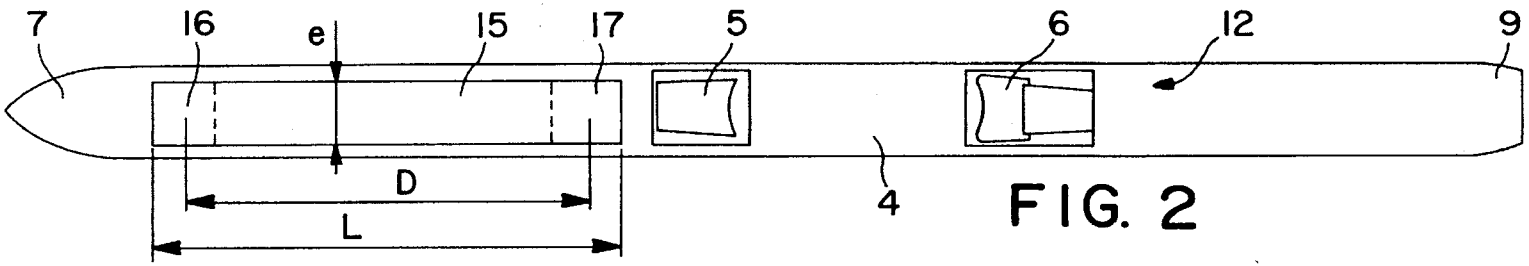
Figure 3:
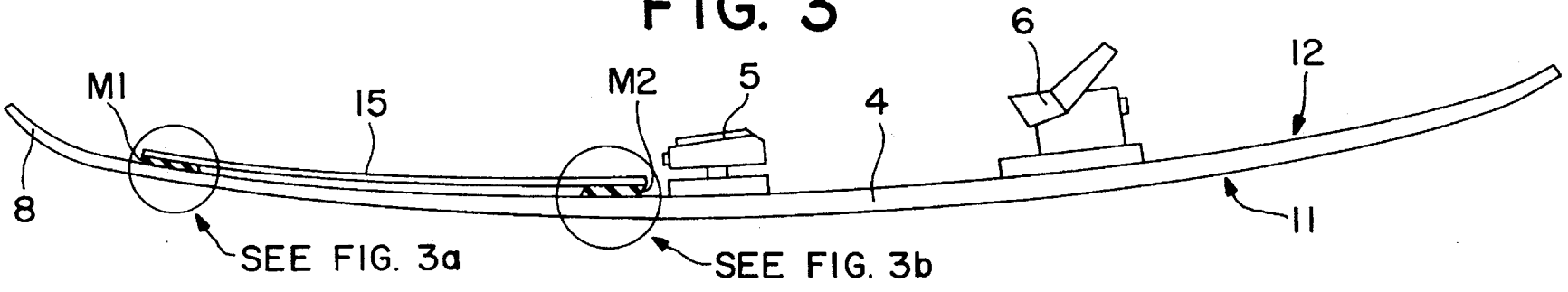

FIGS. 1 to 3 illustrate a first embodiment according to which the two linkage means M1, M2 are flexible. Thus, the front end forming the first linkage area 16 of the flexion plate 15 is connected to the upper surface of the ski by a first damping mechanism M1 constituting the flexible linkage means. Accordingly, an interface 18 made up of a layer of a flexible elastic, and especially viscoelastic, material is placed between the front end 16 of the flexion plate 15 and the ski. This layer has a thickness "$e_1$" and is glued or welded, beneath the lower surface 19 of the plate and, on the upper surface 12 of the ski 2. It may, for example, have the same width as the width "1" of the plate, and a width "$L_1$" of between 2 and 15 centimeters. The surface area of the layer is between 200 and 6,000 $mm^2$. The layer may have a rectangular or any other shape. The first interface 18 is attached beneath the plate 15 and on the upper surface 12 of the ski either using a duroplastic epoxy polyester, vinylester, or polyurethane resin, or a thermoplastic film, or by any other means.

Similarly, the rear end forming the second linkage area 17 of the flexion plate 15 is connected to the ski by a second damping means M2 similar to the first. Thus, an interface 20 made up of a layer of a flexible elastic, and in particular viscoelastic, material is placed between the rear end 17 of the flexion plate 15 and the ski. This thickness layer "$e_2$" is glued or welded beneath the lower surface 19 of the plate and on the upper surface 12 of the ski 2. The surface area of the layer is between 200 and 6,000 $mm^2$. The layer may be rectangular or have any other shape. The interface 20 is attached beneath the plate 15 and on the upper surface of the ski either using a duroplastic epoxy polyester, vinylester, or polyurethane resin, a thermoplastic film, or any other means.

Figure 1B:
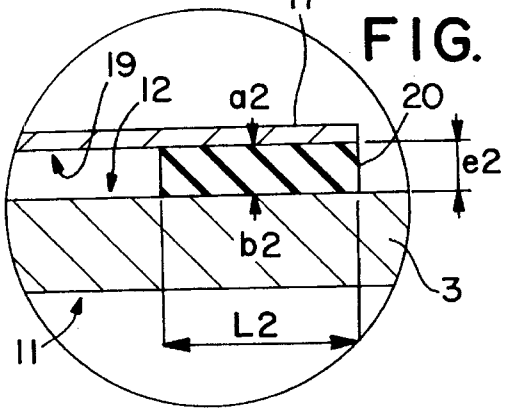
Figure 1A:
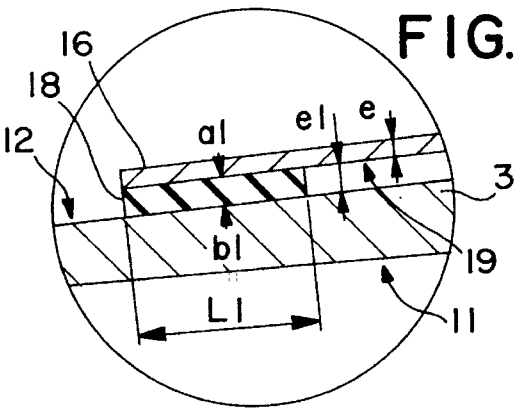

FIGS. 1, 1*a*, 1*b*, 3, 3*a*, and 3*b* illustrate the damping function schematically. FIGS. 1, 1*a*, and 1*b* show the ski in the resting state. In this state, the point "a1" on the front end 16 of the plate corresponds to the point "b1" on the upper ski surface. During flexion (FIGS. 3, 3*a*, 3*b*), the flexion plate 15 moves longitudinally in relation to the upper ski surface, and it is found that the point "a1" has moved forward by a distance "d1" in relation to the point "b1", while point "a2" has moved rearward in relation to the corresponding point "b2" by a distance "d2". During this movement, a shearing, and thus damping, action is produced on the layers of pliable material. The choice of the interface material and of its dimensions determines damping conditions.

Figure 3B:
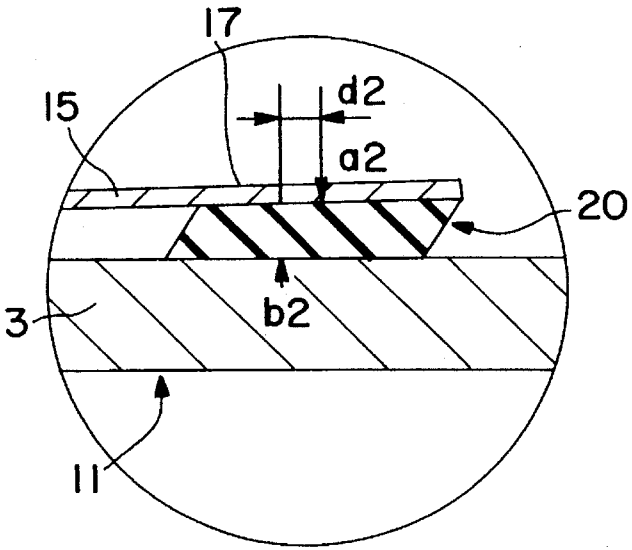
Figure 3A:
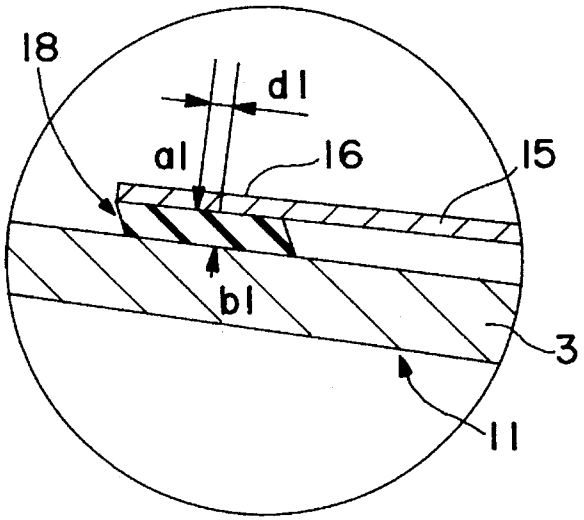

The two interfaces 18 and 20 may be strictly identical, but they may advantageously be different. For example, they could have different dimensions and/or be made of a different material. Accordingly, the thickness "e2" of the second interface 20 could be different and, for example, greater than the thickness "e1" of the first interface 18, as illustrated in FIGS. 1 to 3. Similarly, the first interface 18 could be made of a harder material than the material of the second interface 20. As an example, the first interface 18, which is located in the area where there exists the maximum amount of energy of deformation resulting from the third mode of flexion and the first mode of torsion, must therefore dissipate these two types of vibrations, and, to that end, it may be made of a viscoelastic material having a hardness of approximately 60 Shores A and have a thickness of approximately 0.5 millimeters. Similarly, the second interface 20, which is located rearward, near the central zone 2 of the ski, must dissipate the first mode of flexion and may be made of a viscoelastic material having a hardness of less than 20 Shores A and have a thickness of 4 millimeters. In another example, the first interface 18 may be positioned in the area where there exists maximum deformational energy resulting from the second mode of flexion, and the second interface 20, which is located rearward, near the central zone 2, must dissipate the first mode of flexion. The flexion plate 15 forms a linking element joining the two interfaces 18, 20, thus making it possible to obtain greater relative movement of the rear end 17 of this plate in relation to the ski, as shown in FIGS. 3, 3*a* and 3*b*, where the movement "d2" is greater than the movement "d1".

Figure 4:
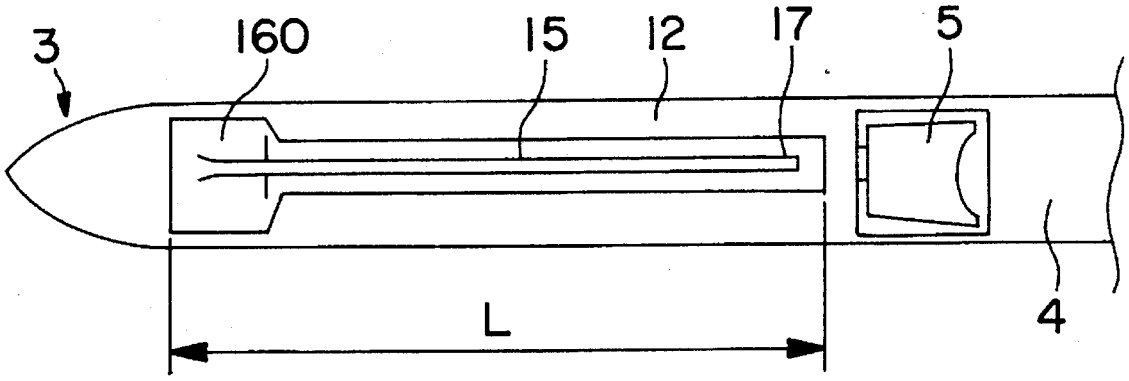
Figure 5:
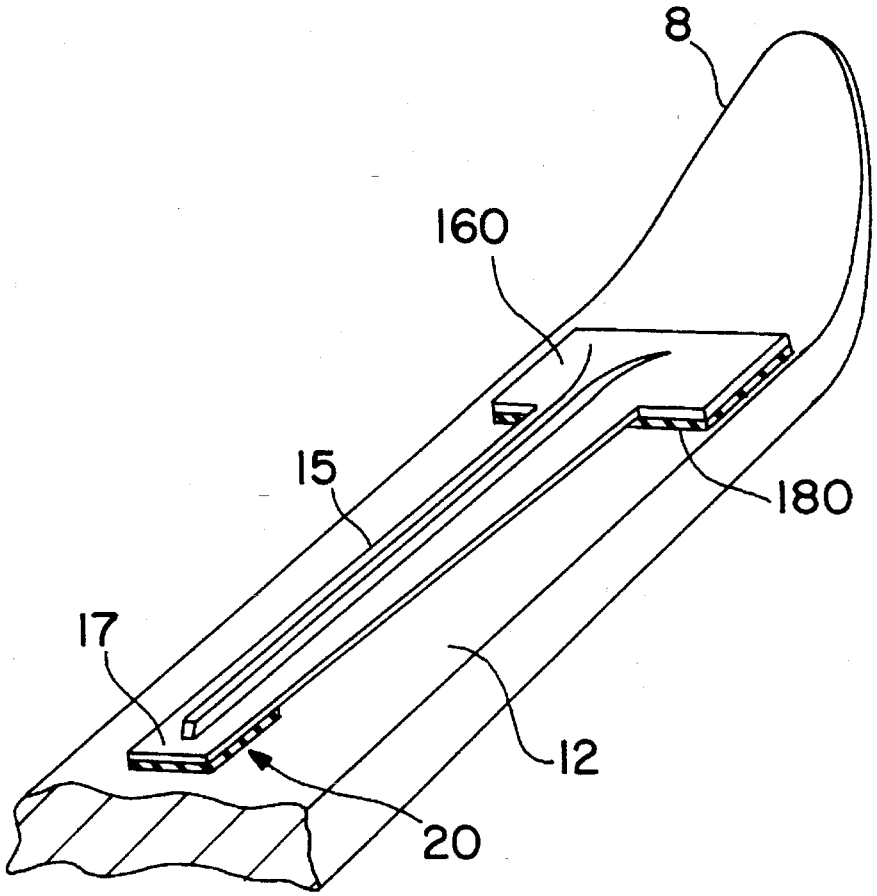

Of course, the flexion plate may have any desired, shape and, in particular, that shown as an example in FIGS. 4 and 5. In this variant, the plate 15 has a shaped section with a central ridge extending over a certain length of the plate so as to avoid buckling of this plate. At the front end of the plate, an enlarged area 160 is connected to the ski surface by a front interface 180. The plate or shaped section can be made by injection of a filled plastic material. The modulus of the material and the section of the plate are chosen so as to obtain the desired stiffness under compression. When materials having high moduli, such as steel or carbon, are used, the plate may be replaced by a simple cylindrical or rectangular retaining ring having a small cross-section, in order not to exceed overly-large values under compression.

Figure 6:
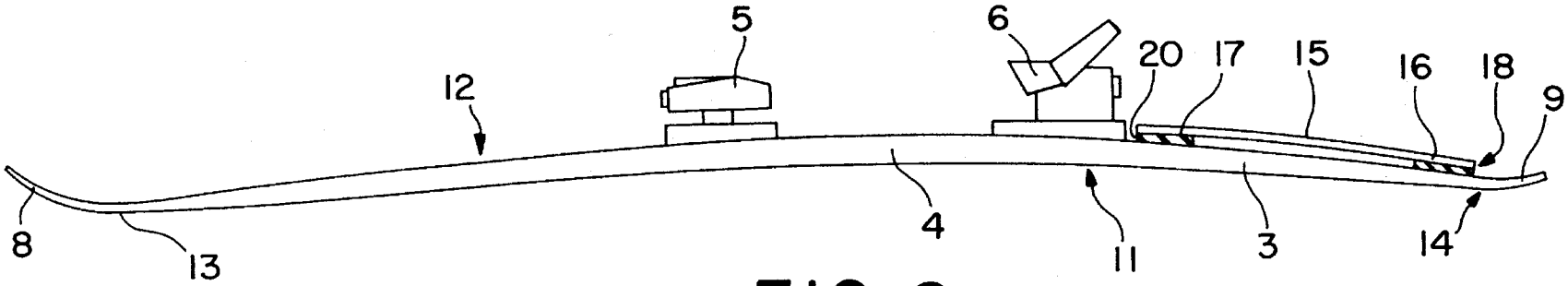
FIGS. 6 and 7 illustrate a variant of the invention, FIG. 6 being a side view and FIG. 7 being a top plan view.
Figure 7:
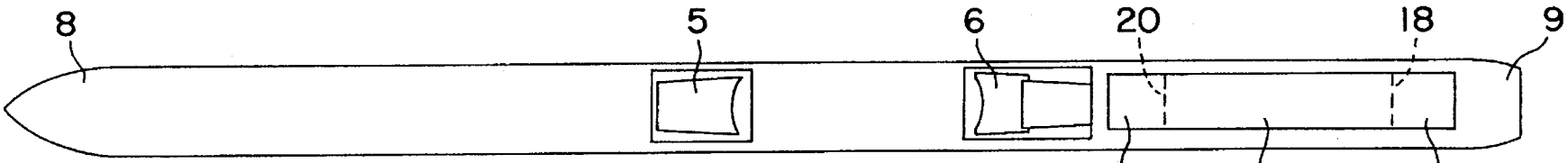

It is obvious that the damping device may be arranged on the ski elsewhere than on the front, and, in particular, on the rear of the ski, as shown in FIGS. 6 to 7, where parts similar to those in the preceding embodiment bear the same reference numbers. Thus, everything described with respect to the device placed on the front, illustrated in FIGS. 1 to 5, remains valid for the device positioned on the rear.

Figure 8:
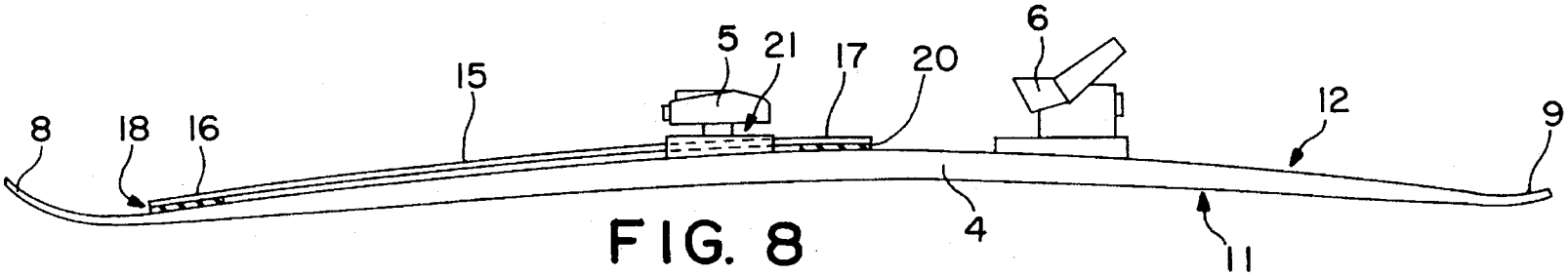
FIGS. 8 to 10 illustrate a further variant, FIG. 8 being a side view, FIG. 9 a top plan view, and FIG. 10 a cross-section view along line X—X in FIG. 9.
Figure 10:
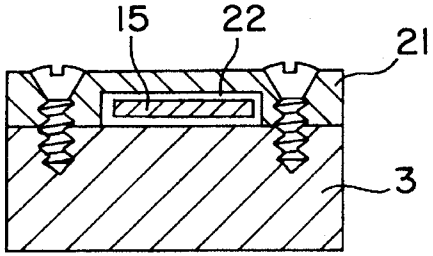
Figure 9:
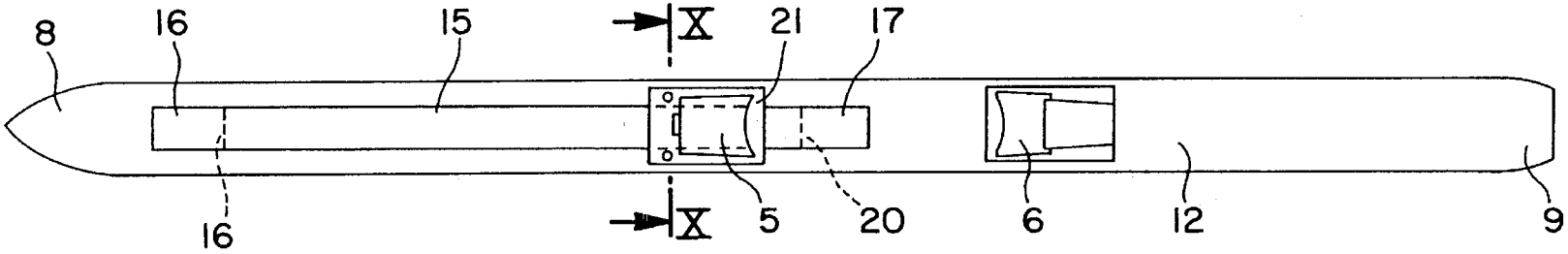
Figure 11:
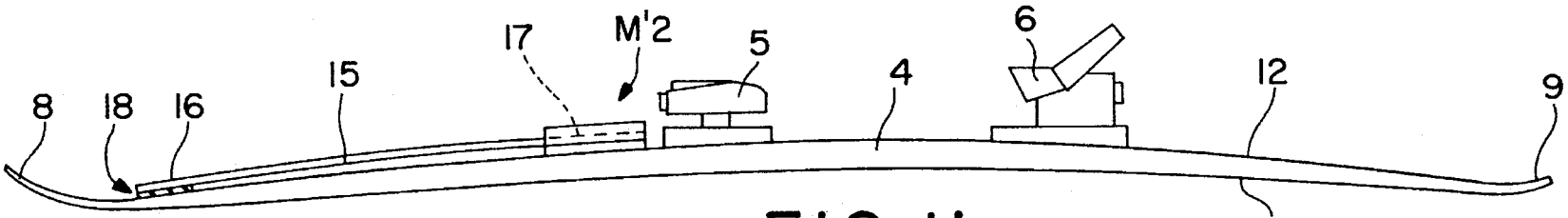
FIGS. 11 to 15 represent another variant, FIG. 11 being a side view, FIG. 12 a top plan view, and FIGS. 13 and 14 being cross-section views along lines XIII—XIII and XIV—XIV, of FIG. 12 respectively.
Figure 14:
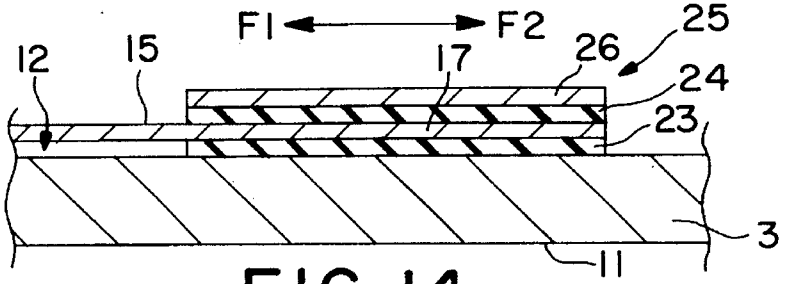

It is also evident that the flexion plate could extend into the central area 4 of the ski, as shown in FIGS. 8 to 10. In this case, the flexion plate 15 passes freely beneath the base plate 21 belonging to the stop, whose lower face comprises a recessed profile 22 whose dimensions are greater than the dimensions of plate 15, in order to allow passage of the plate and unrestricted motion.

In the embodiment previously described, the two linkage and damping mechanisms M1, M2 are made of a layer of a viscoelastic material adhesively bonded or welded simultaneously to the plate and to the ski, so that the damping effect is produced by shearing action produced on the elastic layer, as explained previously. However, this arrangement could be varied. For example only one of the damping mechanisms M1 or M2 could be made of a layer of a glued pliable material serving as interface producing a shearing action, while the other of the damping mechanisms M2 or M1 could be of the dry or viscous friction type. The term viscous friction signifies friction which can be generated during relative displacement of the surface of the plate in relation to the contact surface touching a viscous fluid or a viscoelastic material.

FIGS. 11 to 16 illustrate a variant in which the flexion plate 15 is connected to the front 16 of the ski by a damping mechanism M1 similar to those described above, while its rear end 17 is connected to the ski longitudinally in movable fashion by friction means M'2, which are formed from two layers 23, 24 of a material having a high coefficient of dry friction, and a position-retention and support clamp 25. The material having a high coefficient of dry friction may be constituted, for example, by a layer of thermoplastic rubber or of a viscoelastic material. Accordingly, a first layer 23 of rubber is glued to the upper surface 12 of the ski, while a second layer 24 is glued beneath the central wall 26 of the position-retention clamp, which is shaped like an Ω (omega) and which is fastened to the ski by screws (27). The rear end 17 of the flexion plate may thus be moved in the direction F1 and F2 between the first layer and the second, rubber layer. To ensure that the energy of the longitudinal movements along F1 and F2 of the plate is dissipated, the clamp maintains pressure and squeezes the plate between the two layers. To this end, the height h of the lower housing 28 of the clamp is slightly less than the sum of the thicknesses of the plate and of the two layers, when these latter are at rest and not squeezed by the clamp.

Figure 15:
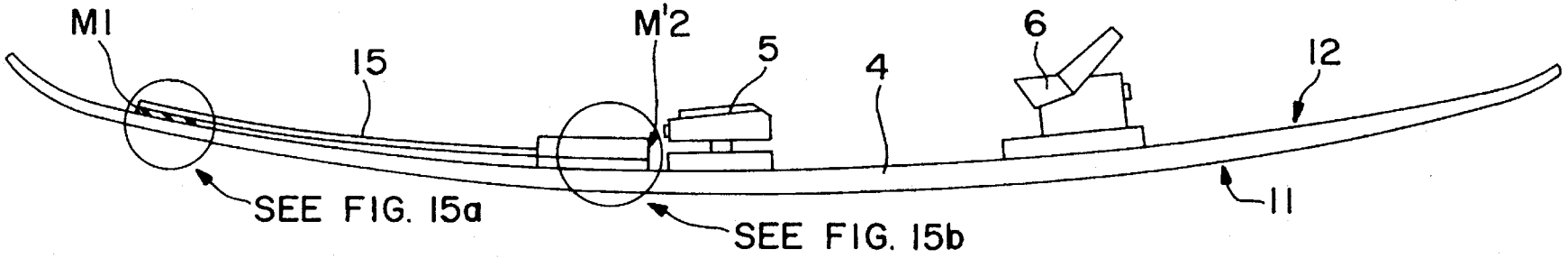
Figure 15B:
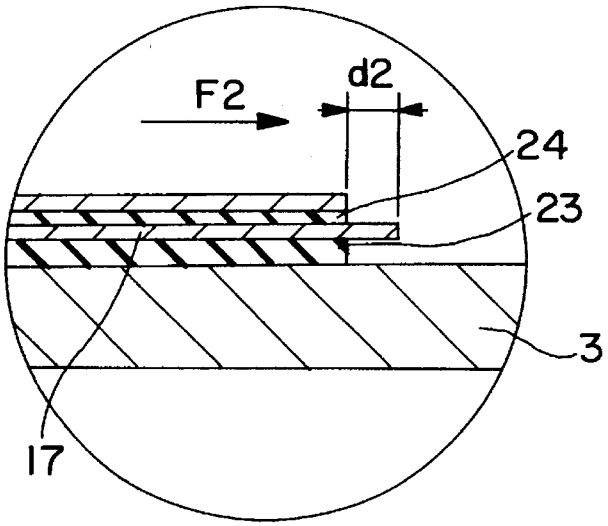
Figure 15A:
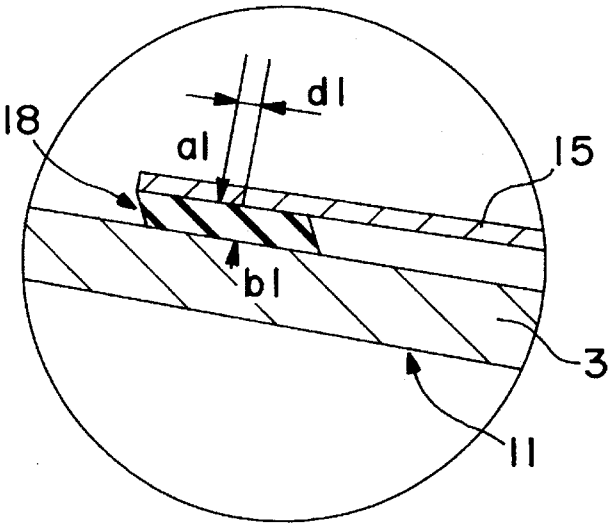

FIGS. 15, 15*a*, and 15*b* show the ski in FIGS. 11 to 14 during flexion, illustrating the damping effect. During flexion, the flexion plate 15 moves longitudinally in relation to the upper surface of the ski, and it is found that the point "a1" has moved forward by a distance "d1" in relation to the corresponding point "b1", while the rear end has moved rearward in the direction F2 by a distance "d2," and this motion has been slowed by the friction layers 23, 24.

Of course, the intensity or tightening force of the friction plate between the two friction layers can be made adjustable as a function of the desired damping effect.

Figure 13:
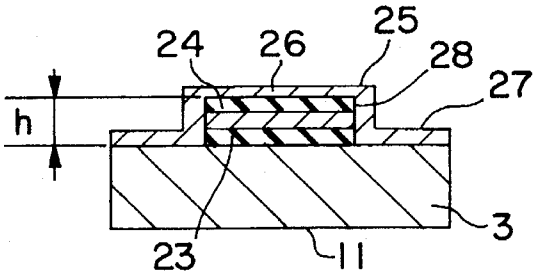
Figure 12:
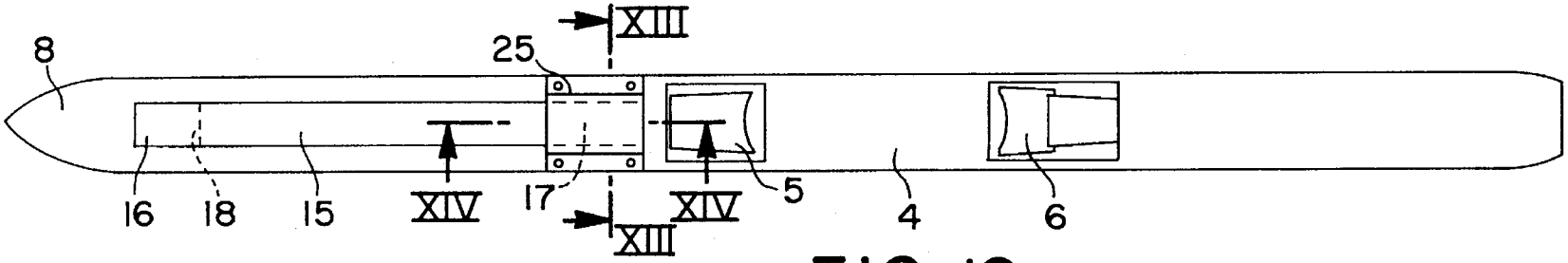
Figure 16:
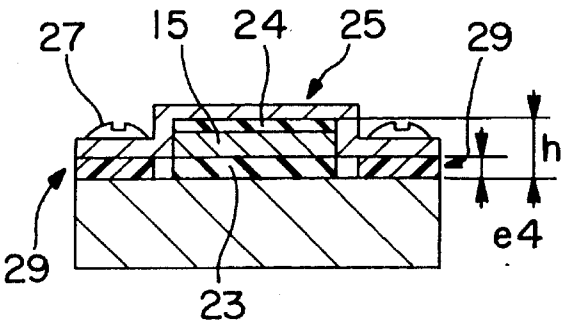
FIG. 16 is a view analogous to FIG. 13, showing a variant.

FIG. 16 is a view similar to FIG. 13, and shows an embodiment of the means for adjustment of the tightening force, and thus the intensity of the friction. According to this variant, the clamp 25 is not supported directly on the upper surface 12 of the ski, but on an intermediate elastic layer 29. Thus, the magnitude of the tightening action applied to the screws 27 determines the tightening force of the plate 15 between the two layers 23, 24 through variation of the thickness $e_4$.

FIGS. 17 to 20 illustrate a variant in which the flexion plate is connected to the front part of the ski 16 by a damping mechanism M1 formed by a flexible interface 18, as previously described, while the rear end 17 is connected to the ski longitudinally and in movable fashion by damping mechanisms M"2 of the viscous friction type, which constitute a movable viscous linkage with the ski. To this end, the friction and absorption means M"2 are constituted by a sleeve or clamp 30 attached to the ski by screws 27 comprising a housing in which the flexion plate slides and which is filled with a viscous substance such as silicone grease, mastic, or other material. The sleeve is formed by a U-shaped clamp, which is attached to the ski and comprises an upper wall 31 and two side walls 32, 33. Thus, the sliding part of the flexion plate 15 is in the sleeve and is completely immersed in a layer of grease or mastic forming a viscous film: an upper layer 34, a lower layer 35, and two side layers 36, 37. The rear end 17 of the flexion plate may thus move longitudinally inside the sleeve in the directions F1 and F2. Consequently, under flexion, the rear end of the plate undergoes relative motion rearward in relation to the friction means. This movement is slowed by the layers of viscous material 34, 35, 36, 37. This braking, and thus damping, effect also obviously occurs in reverse relative motions, i.e., in the direction F1 during return movements to the initial position and in the direction running counter to the arrow.

The viscous substance can be of any type, and it may, for example, have a viscosity at 40° C. of between 20 and 1,500 poises. The viscosity is advantageously about 400 poises. This substance may be grease or a mineral or organic mastic.

Of course, the damping devices illustrated in FIGS. 11 to 20 could be arranged to the rear of the ski, as shown in FIGS. 6 and 7 with respect to the damping device in FIGS. 1 to 3.

According to the embodiments previously described and illustrated in FIGS. 11 to 20, the damping mechanisms of the dry friction type M'2 or of the viscous friction type M"2 connect the rear end 17 of the plate 15. However, the arrangement could be different, and, in particular, it could be the front 16 of the flexion plate that is connected to the ski by these means, while the rear end could be connected to the ski by the flexible damping mechanisms, i.e., those means 18, 20 described and illustrated in FIGS. 1 to 3.

Figure 21:
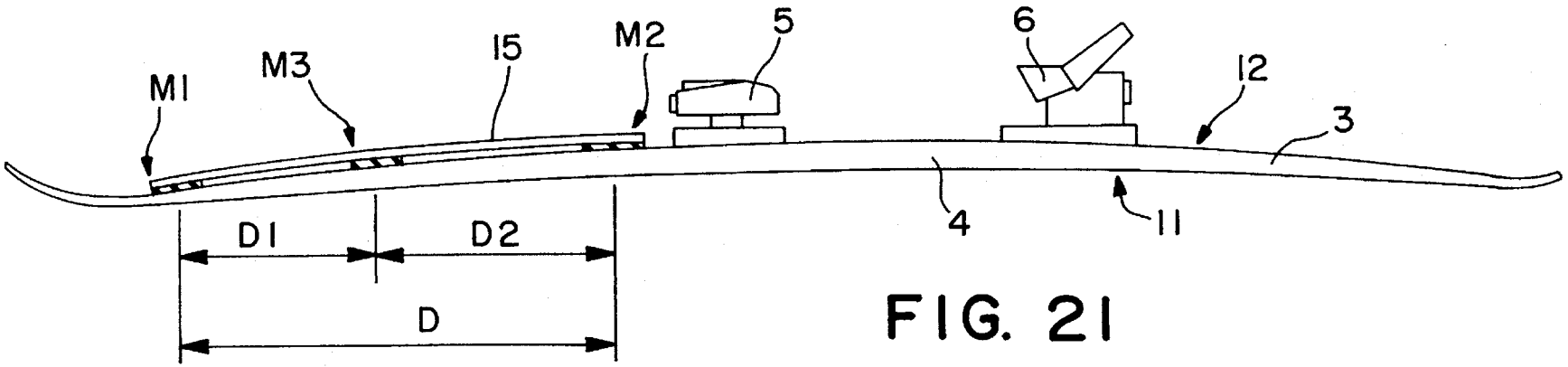
FIG. 21 is a side view of a further variant of the invention.

FIG. 21 illustrates a special embodiment in which a third damping mechanism M3 is positioned between the modes M1 and M2, at an average distance "D1" from M1 and "D2" from M2, respectively. The mechanism M3 may be of any type, as previously described, i.e., of the flexible interface dry or viscous friction type.

Figure 22:
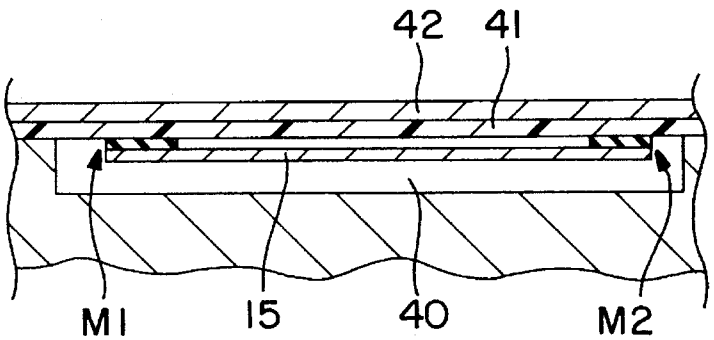
FIG. 22 is a cross-section view of a detail according to a specific embodiment.
Figure 17:
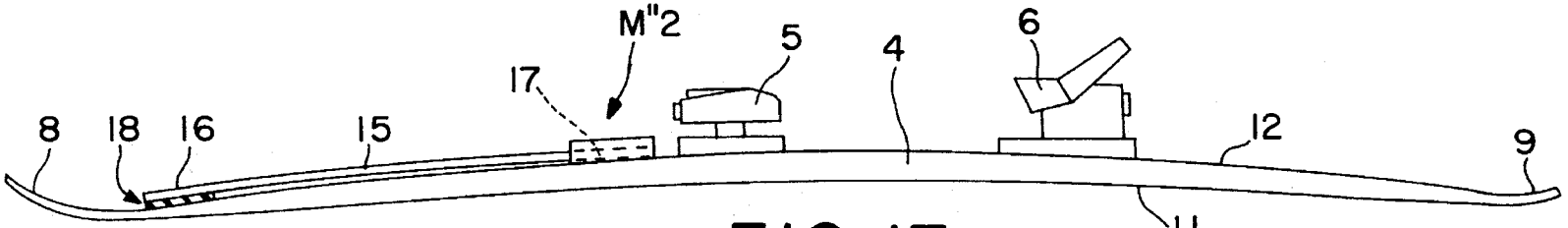
FIGS. 17 to 20 illustrate a variant, FIG. 17 being a side view and FIG. 18, a top plan view.
Figure 20:
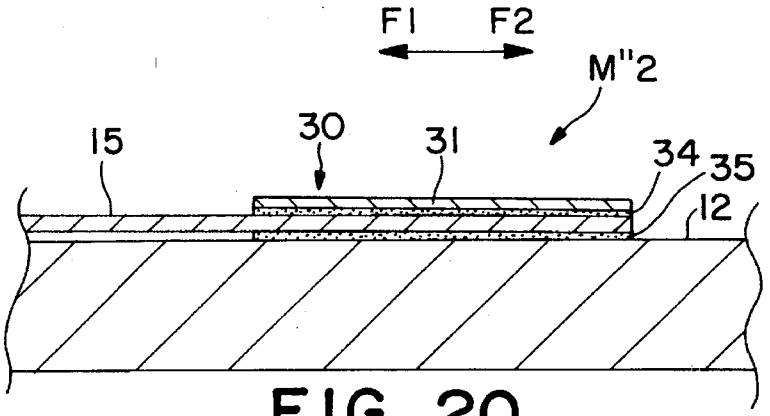
Figure 19:
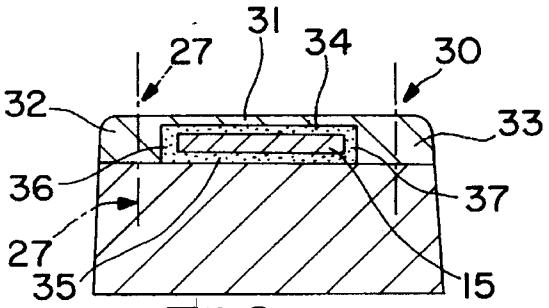
Figure 18:
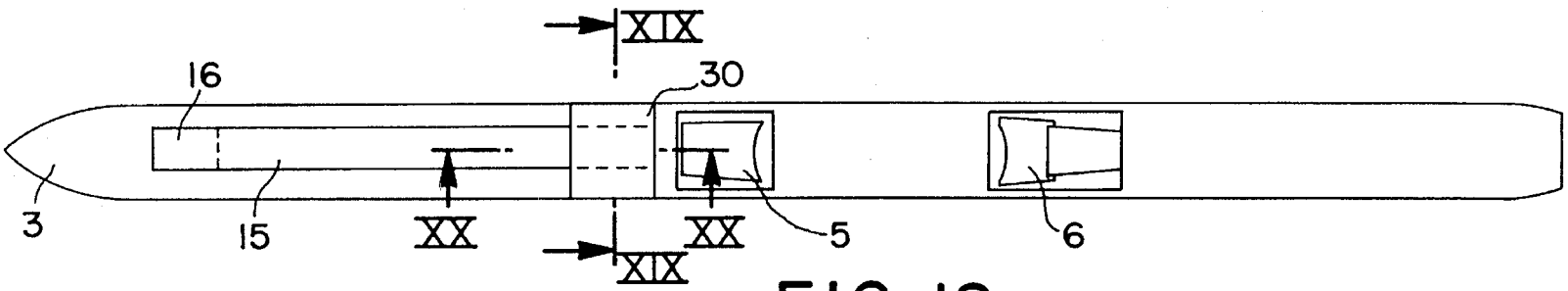

FIG. 22 illustrates the case of a device incorporated into the ski structure. More specifically, the ski is equipped with an inner longitudinal housing 40 and allows the plate to move freely when the ski is stressed. This housing is covered with an inner reinforcement layer 41 and a protective, decorative cover 42.

Figure 23:
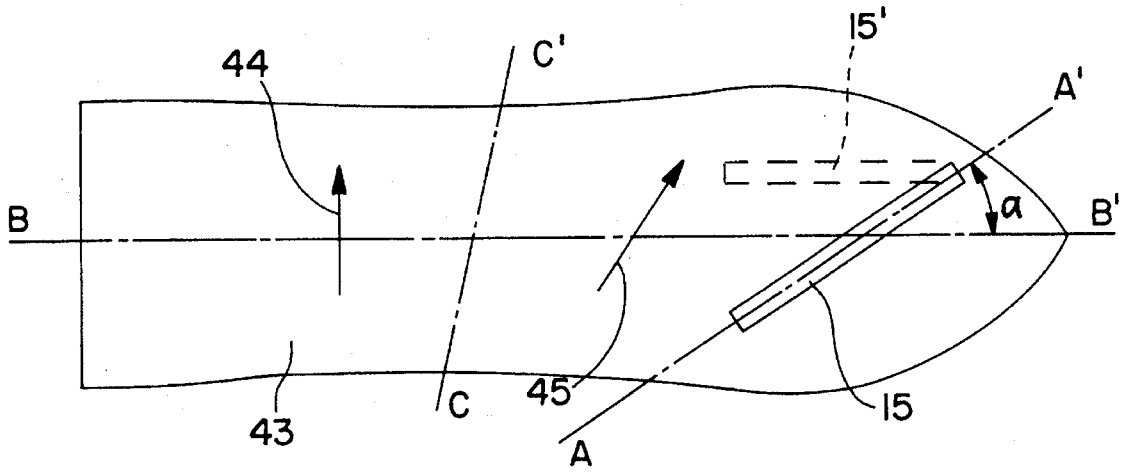
FIGS. 23 and 24 are, respectively, a top view and a cross-section view, along A-A' of FIG. 23, of a surf ski equipped with a device according to the invention.
Figure 24:
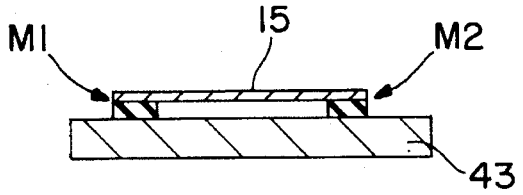

FIGS. 23 and 24 illustrate the use of the device according to the invention on a snow surf ski 43. In this specific case, it may prove advantageous to orient the device along the axis A–A', which extends at an angle α in relation to the median longitudinal axis B–B' of the surf ski. Indeed, in contrast to the alpine ski, the surf ski is used asymmetrically. The surfer adopts a steering position which causes him to generate stresses in the direction of the toes (to the front side) and in the direction of the heels (to the backside) along an axis C–C' corresponding substantially to the axis of symmetry of the bindings 44, 45. Accordingly, it may be advantageous to orient the device more or less at an angle α in relation to the median longitudinal axis B–B' of the surf ski. It is obvious that the device could be arranged differently, and, in particular, according to the configuration illustrated in broken lines. According to this configuration, the flexion plate 15' does not fall within the axis B–B' of the snow surf ski 43 and extends substantially parallel to this axis.

What is claimed is:

1. A device for dampening vibration of a ski having a central zone in which bindings are mounted and front and rear points of contact with the skiing surface, said device comprising:

(a) at least one flexible blade having a first portion and a second portion, said blade extending between said central zone and one of said front and rear points of contact;

(b) at least two dampening connection devices spaced apart longitudinally and affixed to said ski to allow said flexible blade to move longitudinally in its entirety over its entire length with respect to said ski upon flexion, said dampening connection devices being selected from the group consisting of:

(i) an interface of at least one layer of a viscoelastic material welded or adhesively bonded to at least one of said first and second portions of said flexible blade;

(ii) a frictional connection whereby at least one of said first and second portions of said flexible blade comprises at least one surface in a longitudinal friction sliding relationship, with respect to a surface of said dampening connection device affixed with respect to said ski, during use of said ski, at least one of said surfaces comprising a surface of a friction layer having a high coefficient of friction; and (iii) a viscous connection whereby at least one of said first and second portions of said flexible blade comprise at least one surface in a longitudinal viscous friction sliding relationship with respect to a surface of said dampening connection device affixed with respect to said ski, during use of the ski, said viscous connection comprising at least one layer of a viscous material and a sleeve affixed to said ski and having a sliding housing containing said viscous material.

2. Device for dampening vibration of a ski according to claim 1, wherein said flexible blade is a plate, profiled section, or metal retaining rod made of a material selected from the group consisting of aluminum, steel and a composite material.

3. Device for dampening vibration of a ski according to claim 1, wherein said flexible blade has a width (1) of between 10 and 60 millimeters, a thickness (e) of between 1 and 5 millimeters, and a length (L) of between 100 and 1,200 millimeters.

4. Device for dampening vibration of a ski according to claim 1, wherein at least one of said dampening connection devices comprises said interface of viscoelastic material, and wherein the layer of said viscoelastic material has a surface area of between 200 and 6,000 $mm^2$ and a thickness (e1) of between 0.5 and 4 millimeters.

5. Device for dampening vibration of a ski according to claim 1, wherein at least one of said dampening connection devices comprises said frictional connection, and wherein said frictional connection comprises a pressure element and wherein the friction layer is in frictional sliding contact with a portion of said pressure element.

6. Device for dampening vibration of a ski according to claim 5, wherein said friction layer is adhesively bonded to said flexible blade.

7. Device according to claim 5, wherein said friction layer is designed to be adhesively bonded to said ski.

8. Device according to claim 5, wherein said friction layer is adhesively bonded to said pressure element.

9. Device according to claim 1, wherein at least one of said dampening devices comprises said viscous connection, and wherein said sleeve is a U-shaped clamp having a downwardly opening sliding housing.

10. Device according to claim 1, wherein at least one of said dampening devices comprises said viscous connection, and wherein said viscous material has a viscosity at 40° C. of between 20 and 1,500 poises.

11. Device according to claim 10, wherein said viscous material is mineral or organic grease or a mastic.

12. Device according to claim 1, wherein said blade is connected to said ski by three dampening connection devices spaced apart longitudinally.

13. Device according to claim 1, wherein said flexible blade is positioned within said ski.

* * * * *